US006164168A

United States Patent [19]

Anderson

[11] Patent Number: 6,164,168

[45] Date of Patent: Dec. 26, 2000

[54] TOOL MAGNET HOLDER

[76] Inventor: Wayne Anderson, 65 Grove St., Northport, N.Y. 11768

[21] Appl. No.: 09/309,672

[22] Filed: May 11, 1999

[51] Int. Cl.[7] ..... B25B 13/02

[52] U.S. Cl. ..... 81/125; 81/438

[58] Field of Search ..... 81/124.1, 438, 81/439, 185

[56] References Cited

U.S. PATENT DOCUMENTS 3,869,945 3/1975 Zerver ..... 81/125

*Primary Examiner*—Derris H. Banks
*Assistant Examiner*—Daniel Shanley
*Attorney, Agent, or Firm*—Laokenbach Siegel Marzullo Aronson & Greenspan

[57] ABSTRACT

A tool magnet holder is formed of non-magnetic compressible material such as nylon, and has first and second hexagonally shaped contiguous outer walls of different angular dispositions for forcible insertion into a hexagonal recess in the tool, which holder has a central cavity with an integral circumferential protrusion for forcibly receiving a cylindrical magnet, wherein the first hexagonal wall and cavity protrusion provide cooperative compressive forces to permanently retain the magnet in the holder and the holder in the tool for long term heavy duty tool use.

10 Claims, 3 Drawing Sheets

TOOL MAGNET HOLDER

BACKGROUND OF THE INVENTION

1. Field of the Invention

This invention relates to magnet holders for temporarily holding fasteners to tools.

2. Background and Discussion of the Prior Art

The tool art desired accessories for temporarily holding fasteners such as screws or bolts until the tool and fastener were in place and fastening was completed. The tool art looked to magnetic holders to temporarily hold the fastener until the manual or electric tool drove the fastener into the desired location. Such accessories were particularly desired in hard to reach work locations, such as where the user's fingers were ill suited to temporarily hold the fastener.

It was known in the prior art, as shown in FIGS. 1–4B, to provide a generally cylindrical nylon holder 10 formed with a inner cylindrical recess 11 having an inner circumferential protuberance 18 and bottom through hole 12, and three minute downwardly tapered ribs 13 (typical) circumferentially disposed at 120° on a cylindrical peripheral wall 14, for compressible insertion in a cylindrical recess or well 15 of e.g. a socket wrench 16. Ribs 13 are of the order of at most a few thousandths of an inch and are barely visible to the naked eye, and are shown as greatly disproportionately enlarged in FIGS. 1–4B. Ribs 13 compress when inserted into specially machined cylindrical recess or well 15 and secures the nylon holder 10 containing a cylindrical magnet 17 disposed in the inner cylindrical recess 11 which deformably compresses inner protuberance 18. This prior art construction required a specially machined cylindrical tool well 15, and cooperatively, minutely tapered ribs 13, for a compression fit.

Other compressible fit magnet holders for socket wrenches are shown and described in U.S. Pat. No. 5,542,320, granted Aug. 6, 1996 to Vasichek, et al.; U.S. Pat. No. 5,277,088, granted Jan. 11, 1994 to Vasichek, et al.; U.S. Pat. No. 5,199,334, granted Apr. 6, 1993 to Vasichek, et al.; U.S. 5,146,814, granted Sep. 15, 1992 to Vasichek, et al.; and U.S. Des. 369,075, granted Apr. 23, 1996 to Vasichek, et al.

While the foregoing tool magnet holder constructions provided compressible fits, the holder and/or the magnet would with continued use be undesirably dislodged or removed. Insofar as the magnet had to remain intact in place over extensive heavy duty use, the art required a tool magnet holder which more securely, and more permanently, held the magnet in place in the tool than heretofore achieved, and yet also provided a cleaner more effective holder and hand tool design.

It is therefore a principal object of the present invention to provide an improved tool magnet holder.

It is another object of the present invention to provide a tool magnet holder which securely holds the magnet in a tool over an extended period of heavy duty use.

It is still another object of the invention to provide a tool magnet holder and hand tool combination which cooperatively highly compressively holds a magnet therein and which holder itself is compressively held in an efficiently designed hand tool recess.

It is another object of the present invention to provide a tool magnet holder as afore-described which is of unitary one piece molded plastic construction.

It is still a further object of the present invention to provide a tool magnet holder as aforesaid which is of practical design and construction so as to be readily molded of compressible non-magnetic material, and yet which is practical and serviceable over a long period of time in heavy duty use.

SUMMARY OF THE INVENTION

A tool magnet holder is formed of non-magnetic compressible material and a polygonal, preferably hexagonal, shaped peripheral wall for forcibly fitting into a like albeit smaller polygonal recess or well of a tool. The holder is formed with an inner cylindrical wall forming a recess which in turn is formed with deformable protrusion, such as a rounded hemispherical element, formed onto and extending outwardly from the inner cylindrical wall. The protrusion circumscribes a diameter which is smaller than the diameter of the cylindrical magnet. The magnet is forcibly slidably received in the holder cylindrical recess. The protrusion is compressed and deformed when the magnet is fully received in the cylindrical recess to compress the holder against the magnet. The holder and magnet are simultaneously forced fitted into the polygonal tool well. The combination of the deformed inner protrusion and the forced fitted polygonal peripheral wall provide high inner and outer compressive forces on the holder which securely hold the magnet in the holder and the holder in the tool, over long term heavy duty use.

The magnet temporarily holds a fastener, such as a screw or bolt, while the tool drives the fastener into the intended location.

The tool holder is provided with a central bottom through hole for air relief so that the magnet is fully forcibly seated in the holder.

DESCRIPTION OF THE PREFERRED EMBODIMENT

Figure 4A:
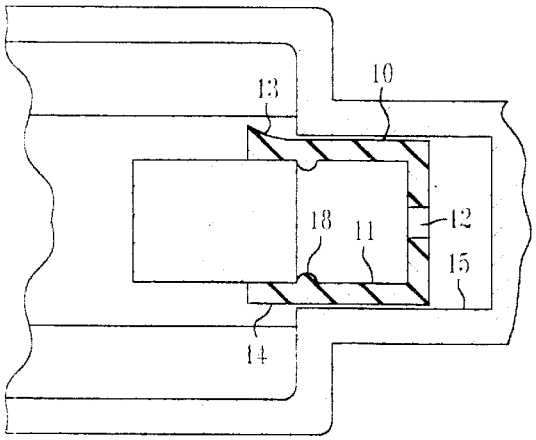
FIG. 4A (PRIOR ART)
FIG. 4A is a sectional view of the magnet holder of FIG. 1 with the magnet being initially inserted into the magnet holder.
Figure 4B:
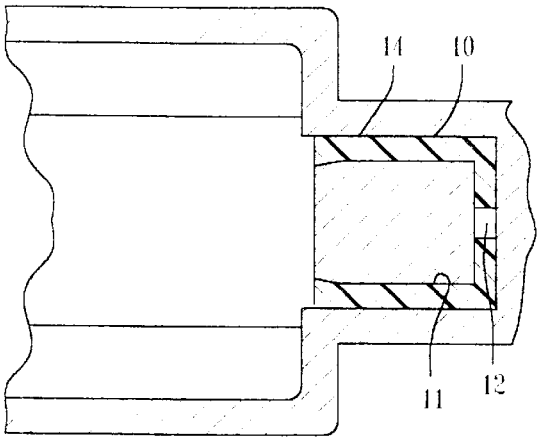
FIG. 4B (PRIOR ART)
FIG. 4B is a sectional view as in FIG. 4A showing the magnet fully seated in the magnet holder and in the tool recess.
Figure 2:
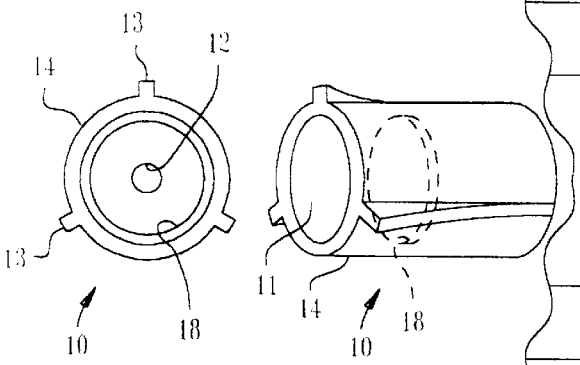
FIG. 2 (PRIOR ART)
FIG. 2 is a top plan view of the magnet holder of FIG. 1.
Figure 3:
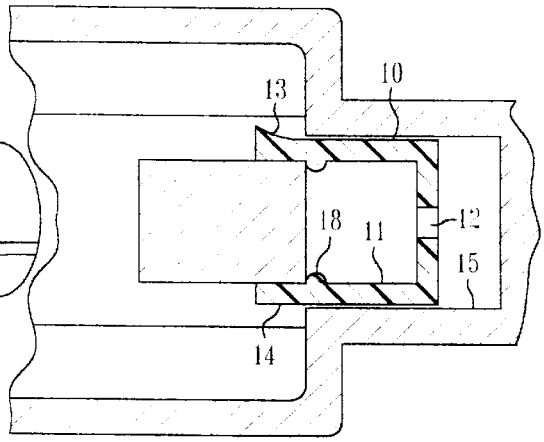
FIG. 3 (PRIOR ART)
FIG. 3 is a perspective and sectional view of respectively the magnet holder of FIG. 1 before and during insertion without the magnet.
Figure 1:
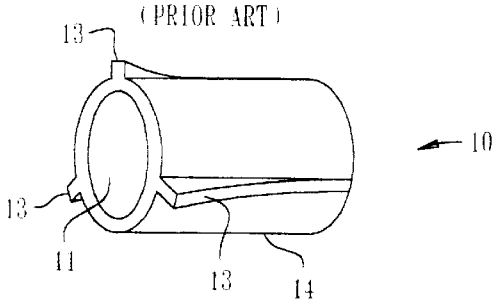
FIG. 1 (PRIOR ART)
FIG. 1 is a greatly enlarged prospective view of a PRIOR ART tool magnet holder, with the tapered outer ribs disproportionally enlarged.
Figure 5:
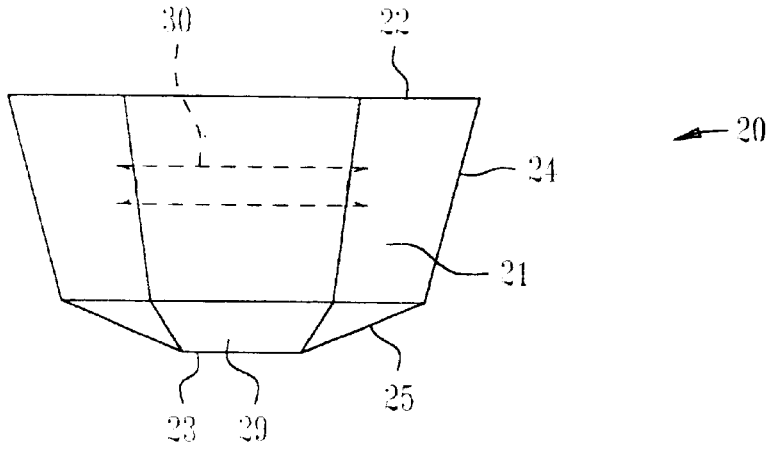
FIG. 5 is a front elevational view of the tool magnet holder of the present invention.
Figure 6:
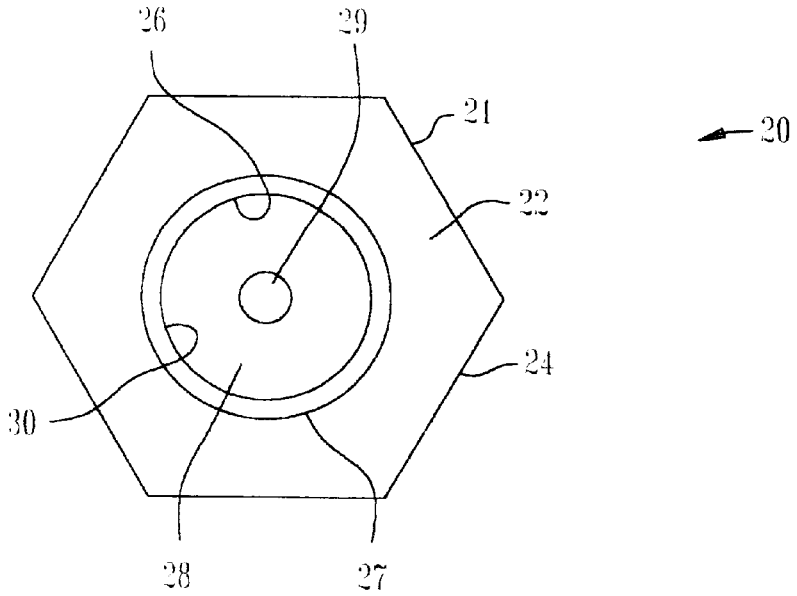
FIG. 6 is a top plan view of the tool magnet holder of FIG. 5.
Figure 7:
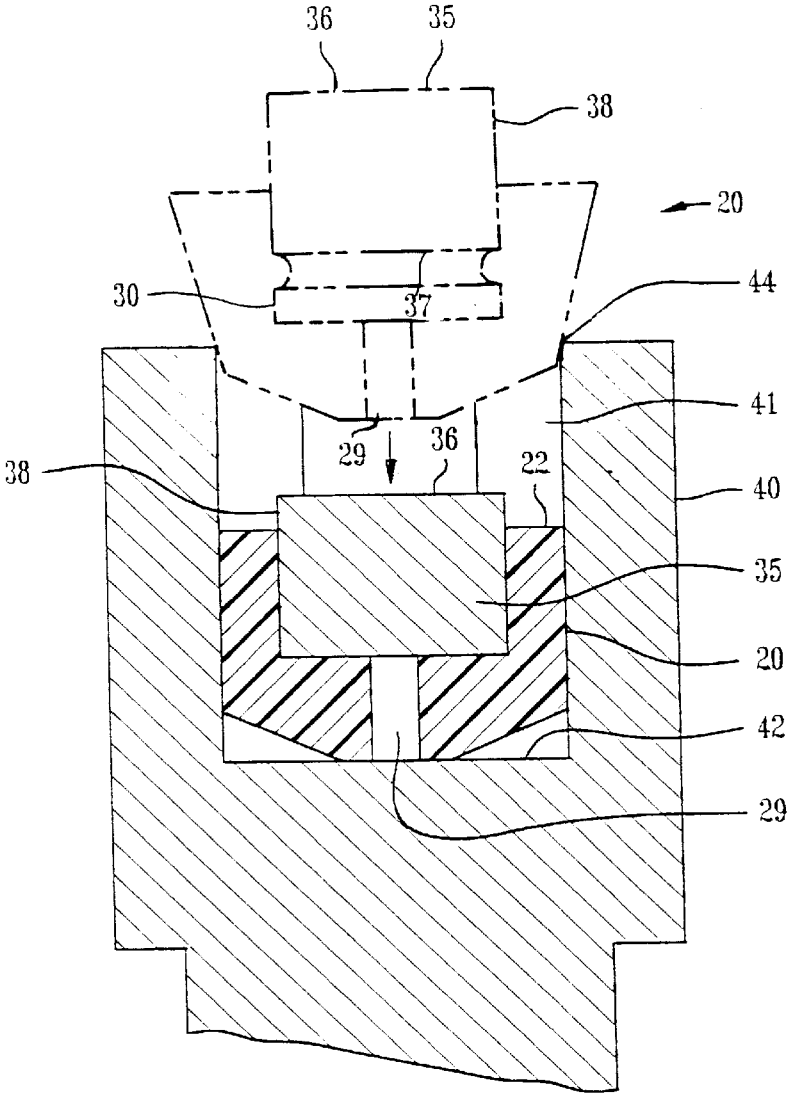
FIG. 7 is two cross-sectional views of the tool magnet holder of FIG. 5, wherein the upper view depicts the magnet holder and magnet just prior to being inserted in the tool well, and the lower view depicts the magnet holder and magnet fully inserted in the tool well.
Figure 8:
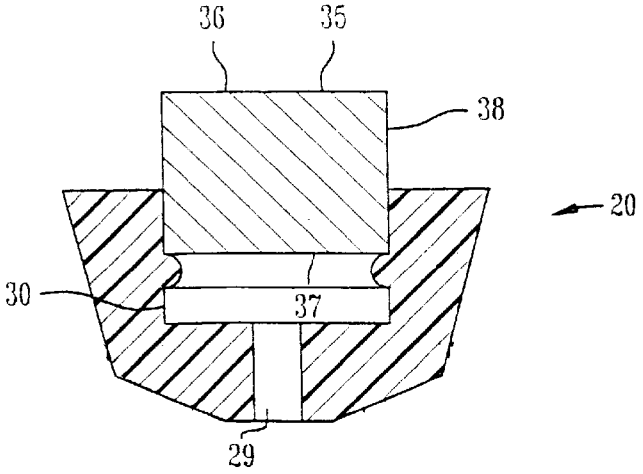
FIG. 8 is a front elevational view of magnet and tool magnet holder as disposed upon initial insertion of the magnet into the tool magnet holder.

Referring to FIGS. 5–7, there is shown the tool magnet holder 20 of the present invention. Holder 20 is formed of a unitary one-piece molded plastic, preferably nylon, member 21. Member 21 is formed of a top 22, bottom 23, an upper hexagonal peripheral wall 24 extending downwardly from top 22, a contiguous lower hexagonal peripheral wall 25 extending downwardly to centrally disposed hexagonal flat bottom 23. First hexagonal peripheral wall 24 is tapered at a first angle, and second hexagonal peripheral wall 25 is tapered at a second angle, wherein the second angle is more acute than the first angle.

Holder member 21 is formed with a recess 26, formed by generally cylindrical wall 27 and bottom inner wall or seat 28. A central through hole 29 extends downwardly from inner wall 28 to bottom 23, for purposes hereinafter appearing.

A protrusion or hemispherical element 30 is thermoplastically integrally press molded or like fixedly integrally bonded to cylindrical inner wall 27. Protuberance 30 is thermoplastically deformable under compressive and shear forces. Protuberance 30 circumscribes a diameter which is less than the diameter of cylindrical wall 27, and less than the diameter of cylindrical magnet 35 (FIG. 7). Magnet 35 is a solid cylinder or pellet 26 having a flat top 30 and an oppositely disposed parallel bottom 31, and a cylindrical peripheral wall 38.

Referring now specifically to FIG. 6, there is shown, in the upper view, member 21 with cylindrical magnet 35 slidably partially disposed in recess 26. The magnet bottom 36 abuts the protuberance 30, and absent considerable force, is blocked by protuberance 30 in this pre-seating position. A socket wrench or like tool 40 is shown with a hexagonal recess or well 41 having a bottom wall 42. It is important to note that in the embodiment of the present invention, the tool recess is a straight hexagonal recess, and the specially machined cylindrical drop well of the FIGS. 1–4B prior art embodiment is eliminated. The tool length of present invention is also considerably less than that of the FIGS. 1–4B prior art embodiment, for the same cross dimension hex size tool.

Upon insertion of holder 20, the upper hexagonal wall or surface 24 first contacts edge 44 of tool well 41. The member 21 with partially inserted magnet 35 is then forcibly inserted into tool well 41. Upon insertion of magnet 35, protuberance 30 is deformed and sheared. The tapered hexagonal wall 24 frictionally slides into hexagonal well 41 and in doing so tapered hexagonal wall 24 assumes the upright shape of the hexagonal tool well wall 41. The magnet 35, with the deformation of protuberance 30, and co-operatively with the deformation of the upper tapered wall 24 is securely compressibly held in 30 member 21, with the member 21 compressibly held in the tool well 41. Hole 29 permits air release and fully seating of the magnet in the holder.

In the fully seated position, member wall bottom 23 abuts tool well bottom wall 42, and member upper wall 24 assumes the shape of and is flush with hexagonal inner wall of well 41. The magnet top 30 extends upwardly and is slightly spaced from member top 22.

In the aforesaid manner of construction, magnet 35 is securely compressively held in member 21, and securely compressively held in tool well 41. The compressive forces generated by the present construction securely hold the magnet in place in long term heavy duty use not heretofore achieved. In use, a ferrometallic fastener or fastener holder (not shown) is received in the well 41 for temporary magnetic holding by the magnet 35.

The member of the present invention may be formed of any moldable material and is preferably made of nylon, or other high impact heavy duty plastic material.

The magnet of the present invention may preferably be an alnico magnet or a rare earth material magnet, such as an Fe—B—Nd magnet.

The present invention is described in temporarily magnetizing a fastener. A broad range of fasteners are within the contemplation of the invention including by way of example, bolts, screws, nuts and the like.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. In combination;

a socket being formed with inner side walls forming a polygonal recess and having a bottom wall extending across the side walls;

a magnet;

a magnet holder comprising a non-magnetic plastic member having a polygonal outer wall and an inner recess wall in which the magnet is received, said holder being deformably compressed between the socket side walls and the magnet so that the magnet and holder are securely retained in the socket; and said holder having a second wall depending from the polygonal outer wall, said holder second wall being spacedly disposed from said socket bottom wall.

2. The combination of claim 1, said holder having a centrally disposed bottom wall, and wherein the holder centrally disposed bottom wall abuts the socket bottom wall.

3. The combination of claim 1, said member second wall comprising a second polygonal outer wall extending from the first polygonal outer wall, and said second polygonal outer wall comprising an angle of taper.

4. The combination of claim 1, said member polygonal outer wall being hexagonal, and said socket polygonal recess being hexagonal.

5. The combination of claim 1, said magnet being an Alnico or rare earth magnet.

6. The combination of claim 1, said socket bottom wall being free of a through hole.

7. The combination of claim 1, said magnet being cylindrical and having a top wall and a bottom wall.

8. The combination of claim 7, said magnet bottom wall abuts the holder.

9. The combination of claim 8, said holder being formed with a hole extending from the holder recess to the holder bottom wall.

10. The combination of claim 1, said holder having a bottom wall and being formed with a hole extending from the recess to the bottom wall.

* * * * *